US005954336A

United States Patent [19]

Goossens et al.

[11] Patent Number: 5,954,336

[45] Date of Patent: Sep. 21, 1999

[54] GAMING TABLE LAYOUT, AND METHOD FOR PLAYING A HIGH-LOW GAME

[75] Inventors: Wilhelmus Johannes Goossens, Bruinisse; Pieter Cornelis Beer, Rotterdam, both of Netherlands

[73] Assignee: Pro-Intro B.V., Bruinisse, Netherlands

[21] Appl. No.: 08/975,641

[22] Filed: Nov. 21, 1997

[30] Foreign Application Priority Data

Aug. 27, 1997 [NL] Netherlands ..... 1006866

[51] Int. Cl.[6] ..... A63F 1/00

[52] U.S. Cl. ..... 273/309; 273/292; 273/274; 273/138.2; 273/143 R; 463/20; 463/27; 463/46

[58] Field of Search ..... 273/309, 274, 273/292, 138.2, 143 R; 463/46, 20, 26, 27

[56] References Cited

U.S. PATENT DOCUMENTS

| | | | |
|---|---|---|---|
| 4,066,264 | 1/1978 | Rowman | 273/143 R |
| 4,930,789 | 6/1990 | Harris et al. | 273/256 |
| 5,494,295 | 2/1996 | Potter et al. | 273/292 |
| 5,556,101 | 9/1996 | Jabro | 273/274 |
| 5,626,341 | 5/1997 | Jones | 273/292 |
| 5,630,586 | 5/1997 | Lowden | 273/138.2 |

*Primary Examiner*—Benjamin H. Layno
*Attorney, Agent, or Firm*—Jones, Day, Reavis & Pogue

[57] ABSTRACT

A gaming table layout for playing a high-low game, comprising several player positions. Each player position has a read-out window, under which a movable image carrier is situated, displaying several successive images. Each image has a combination of a symbol from a first and a second symbol group. The first symbol group is arranged from high to low, and the second symbol group is distinguished by type. Each player position also has a stop button operable by a player, for stopping an image carrier which has been set in motion, and each player position has a bet-placing position. The gaming table layout further comprises a dealer position. The dealer position has a start button operable by the dealer, for setting the image carriers in motion, ad a stop button operable by the dealer, for stopping image carriers of any unoccupied player positions which have been set in motion. The dealer position also has a pile of cards with one of the symbols on the second symbol group displayed on each card.

13 Claims, 2 Drawing Sheets

GAMING TABLE LAYOUT, AND METHOD FOR PLAYING A HIGH-LOW GAME

BACKGROUND OF THE INVENTION

The invention relates to a game and also to a gaming table layout for playing said game. The invention is suitable in particular for use in a casino.

Casinos are an increasing source of recreation for many people. A casino game should preferably be one which can be played quickly and should be simple in concept, so that anyone can learn it quickly. Known casino games are roulette and blackjack. Since, apart from placing chips, roulette requires no active interventions from a player, and many people consider blackjack to be a game which is difficult to learn, it has been found that there is a need for a casino game which is easy to learn, and in which a player feels he can exert more influence on the course of the game.

SUMMARY OF THE INVENTION

To this end, the invention provides a gaming table layout for playing a high-low game according to claim 1, and also a method for playing a round of a high-low game according to claim 9. The high-low game according to the invention is very simple in concept and easy to learn. The fact that the players themselves have a stop button enabling them to stop an image carrier set in motion gives them the feeling of being able to exert a great influence on the course of the game. Players who are not amongst the winners with the highest or lowest value compared with the other players do not lose immediately, but go on to an additional game. The gaming table layout according to the invention is very suitable for use in a casino, a great advantage which can be mentioned being that the gaming table layout corresponds largely to the layout of a conventional blackjack table. In particular, the gaming table layout for playing a high-low game can be such that one and the same table is also suitable for playing blackjack.

Preferred embodiments of the gaming table layout are described in subclaims 2–8.

The high-low game according to the invention can be played with a number of attractive variants which are described in subclaims 10–13.

BRIEF DESCRIPTION OF THE DRAWINGS

The invention will be explained in greater detail with reference to the appended drawing, in which.

DETAILED DESCRIPTION OF THE PREFERRED EMBODIMENTS

Figure 1:
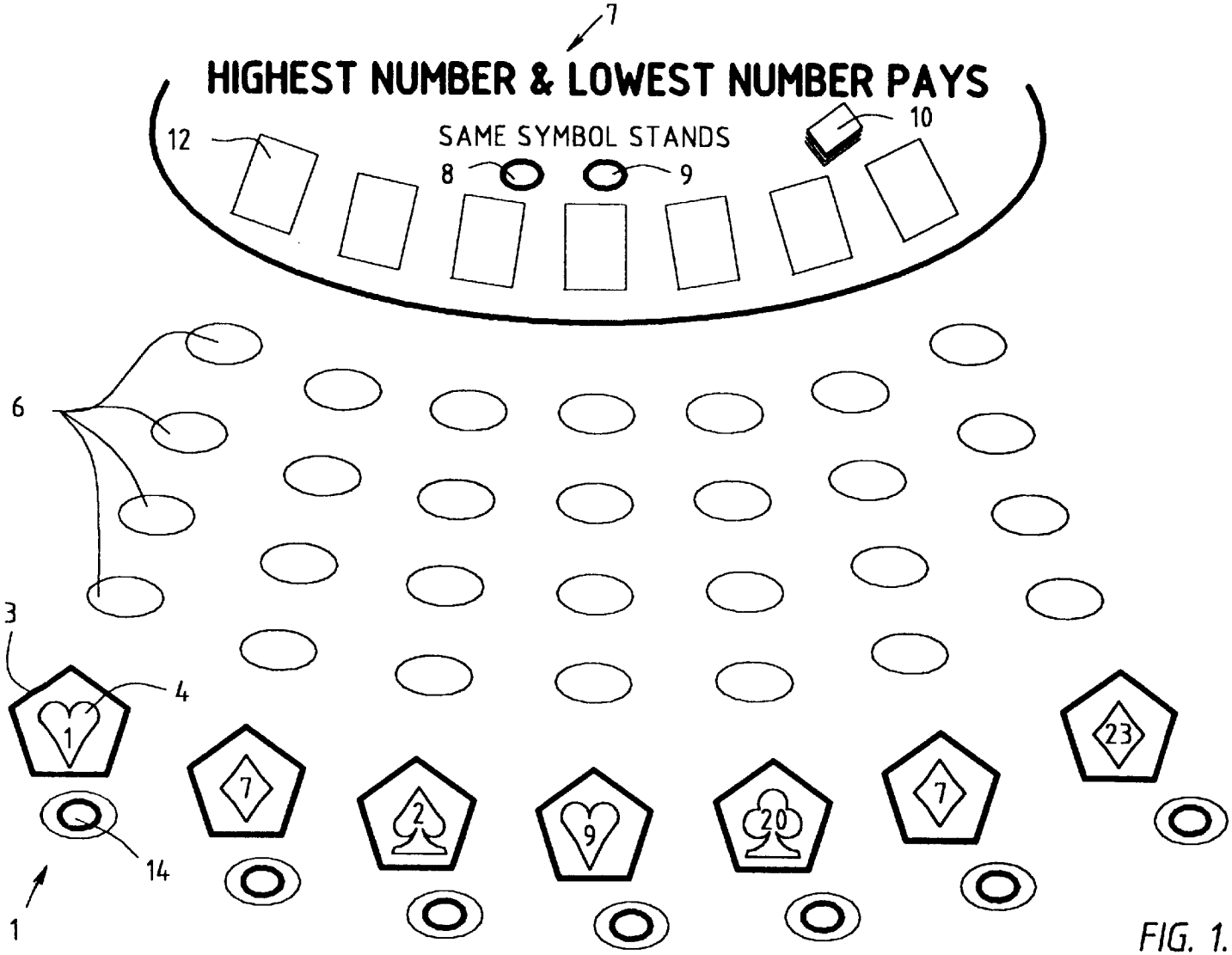
FIG. 1 shows a top view of a gaming table layout according to the invention.
Figure 2:
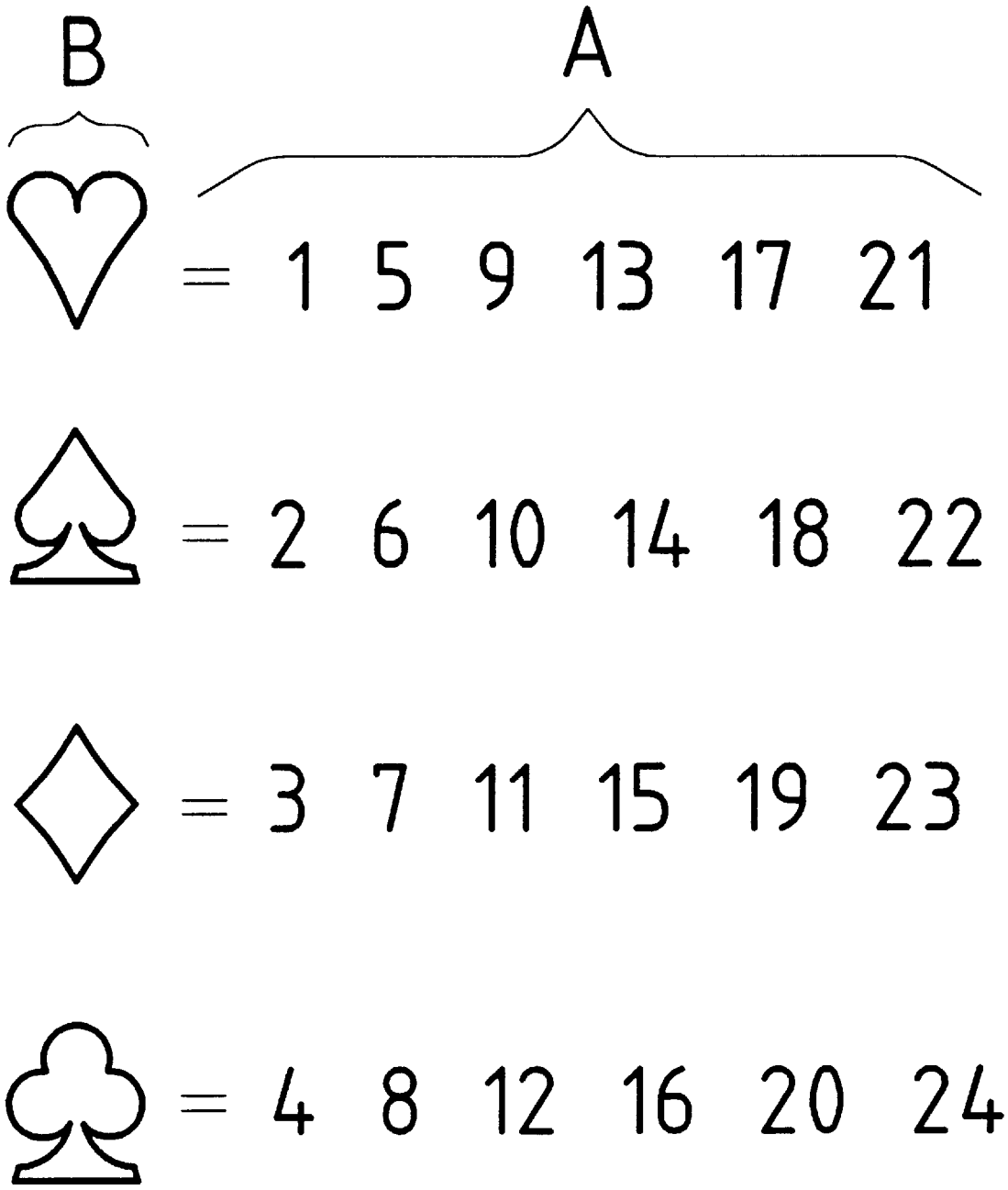
FIG. 2 shows an example of the combinations of symbols displayed on an image carrier according to the invention.

In FIG. 1 the gaming table layout comprises seven player positions 1. Each player position 1 has a read-out window 3, under which a rotatable roller 4 is situated, showing the numbers 1 to 24 in a certain sequence. Each number is combined here with one of the known card symbols, hearts, clubs, diamonds or spades. An example of the possible combination between the series of numbers and the card symbols is shown in FIG. 2. In this example it can be seen that the numbers are distributed proportionately over the four card symbols. Above each read-out window 3 there are four bet-placing rings 6 in which bets are placed. The front bet-placing ring 6 is intended for the main player of the player position 1 concerned, and the other three bet-placing rings 6 are intended for any fellow players. After the players and fellow players have placed their bets, a dealer can place a security slide over the rings 6. This is to ensure that if the game becomes too complicated for the dealer, the dealer can prevent the players from retrieving or increasing their bets unnoticed. At the head of the table there is a dealer position 7. The dealer position 7 is provided with a start button 8 which is operable by the dealer, for simultaneously setting in motion or unlocking the seven rollers 4. Beside the start button 8 there is a stop button 9, by means of which the dealer can stop the rotating rollers 4 again. The dealer also has at his disposal a pile of cards 10, for example a blackjack dispenser or a card shuffling machine. The dealer position 7 comprises seven card positions 12 for depositing one card per player position 1. Each player position 1 comprises a stop button 14 for the player to stop his roller 4 which has been set in motion by the dealer. The stop button 14 is preferably connected to a random generator, which in turn is connected to a drive of the roller 4. The random generator ensures that after a player has operated his stop button 14, the roller 4 continues to rotate until it reaches a position which the random generator has calculated. It thus appears to the player that he has an influence on the position at which the roller stops, while this is not the case, because the random generator calculates this position. By this measure it is ensured that the high-low game according to the invention is a pure game of chance.

The game is now played as follows: players take up their player positions 1 and place a sum of money or a number of chips on the bet-placing rings 6. Any fellow players can also place a bet on the table. When all players have placed their bets, the dealer gives a sign that no further bets may be placed and, if he wishes, places security slides over the rings 6, and the dealer then starts the rollers 4 by operating his start button 8. Each player can now make his own roller 4 stop by operating his own stop button 14. If not all player positions 1 are occupied, the dealer can stop the rollers 4 of the unoccupied player positions 1 by means of his stop button 9. After all rollers 4 have been stopped, it can be determined which players have the highest and lowest number compared with each other. These players have won the game and receive a pay-out, for example twice their bet. If there are several players who have the lowest or the highest number, all these players have won. As a special rule, it can also be stipulated that the highest number pays out twice the bet, while the lowest number pays out once the bet. The players who have not won now continue to play, in order to try at least to retain their bet. For this, a card is put down by the dealer at the card positions 12 of the players who have not won. If the card symbol present under the read-out window 3 of the player corresponds to the symbol on the card turned over for his player position 1, then the player may retain his bet. After all player positions 1 have had their turn in this way, the game has ended, and a new round of the game can begin.

A number of variants of the game described above are possible, so that the high-low game can be made even more attractive for players. A possible variant of the game is the addition of a jackpot variant. For this, a player can place a coin in a slot to be provided specially at his player position. After a round of the game has begun, a jackpot indicator, for example a red light, will go on at the player position concerned, making it clear that the player is participating in the jackpot during that round of the game. If a certain limiting condition is met, for example if the same numbers or symbols fall at six or seven player positions, the jackpot or part thereof can be paid out to those players participating in the jackpot in that particular round of the game.

Another variant focuses on the course of the game after the highest and lowest values have been determined. The then remaining players can be offered an interim game in which the player has a certain chance of winning. If the player wins the interim game, he retains his bet or even receives an additional pay-out. Such an interim game must not be too complicated, and the game decisions must remain simple, so that a player can quickly work out how his chances change with each decision. An example of such an interim game is as follows: as described above, after a card has been turned over for a particular player position, players look to see whether the symbol of the card which has been turned over corresponds to the image present under the read-out window. If this is the case, then the player can pass and retain his bet. However, if also the number of the card turned over is lower than the number present under the read-out window, the player has the possibility of requesting additional cards from the dealer. The dealer in that case adds cards until all card numbers turned over, when counted together, have the same total value as the number present under the read-out window of the player. Only the symbol of the first card turned over is of importance here, while for the remaining cards it is a question of counting up the numbers. In the event of success, there can be a large pay-out. If the total value of the card numbers exceeds the number present under the read-out window, the player loses his bet.

In yet another variant additional pay-outs may be made for certain combinations of symbols or numbers.

This means that according to the invention an attractive game is provided, suitable in particular for playing in a casino, which game can be regarded as a pure game of chance, which cannot be influenced by the players to their advantage, while the players still have the impression that the latter actually is the case. The rules of the game can be kept very simple, and can be extended in a number of variants. Many variants of embodiments are conceivable for the table layout. For example, the number of player positions is variable, and an electronically controlled display can be used as the image carrier, instead of a rotatable roller. There are also many possibilities for the two symbol groups A and B, provided that the first symbol group can be arranged by order of rank and the second symbol group can be compared with carriers of symbols from the second symbol group placed at random on the table by the dealer. For instance, for the first symbol group, clocks with a 24-hour display are also conceivable, in which case the players stop their own clock. This produces, as it were, a number of world times which can be compared with each other. The second symbol group can also consist of, for example, four different colours.

The game according to the invention is not only suitable for use in a casino, but can also be used on the computer, on television and for social games in the domestic sphere.

What is claimed is:

1. Gaming table layout for playing a high-low game, comprising:

several player positions, each player position being provided with:

a) a read-out window, under which a movable image carrier is situated, displaying thereon several successive images, each image in each case being a combination of a symbol from a first and a symbol from a second symbol group, in which the first symbol group is a series of symbols which can be arranged from high to low, and the second symbol group is a number of symbols which can be distinguished by type;

b) a stop button connected to the image carrier and operable by a player, for stopping an image carrier which has been set in motion, in which case a certain image comes to rest in front of the read-out window;

c) at least one bet-placing position for placing money, chips or the like;

a dealer position which is provided with:

d) a start button operable by a dealer, for setting the image carriers in motion;

e) a stop button operable by the dealer, for stopping image carriers of any unoccupied player positions which have been set in motion;

f) a pile of cards with one of the symbols of the second symbol group displayed on each card.

2. Gaming table layout according to claim 1, in which the first symbol group is an increasing series of numbers.

3. Gaming table layout according to claim 1, in which the second symbol group is the symbols hearts, clubs, diamonds and spades.

4. Gaming table layout according to claim 1, in which a random generator is provided for each player position, which random generator is placed between the stop button operable by a player and the movable image carrier.

5. Gaming table layout according to claim 1, in which the movable image carrier is a rotatable roller.

6. Gaming table layout according to claim 1, in which a security slide is provided for covering each bet-placing position.

7. Gaming table layout according to claim 1, in which the gaming table layout is also suitable for playing blackjack.

8. Gaming table layout according to claim 1, in which each player position is also provided with a coin slot and a jackpot indicator coupled thereto.

9. Method for playing a round of a game in a high-low game, comprising the steps of:

a) players placing a sum of money, chips or the like;

b) setting movable image carriers for all player positions in motion, each image carrier being provided with several successive images displayed thereon, each image in each case being a combination of a symbol from a first and a symbol from a second symbol group, in which the first symbol group is a series of symbols which can be arranged from high to low, and the second symbol group is a number of symbols which can be distinguished by type;

c) each player stopping the image carrier belonging to his player position, in which case a certain image comes to rest in front of a read-out window;

d) a dealer stopping image carriers of any unoccupied player positions;

e) determining those player positions which compared with the other player positions have the highest or the lowest symbols from the first symbol group in their image, and paying out a fixed win to the players concerned;

f) turning over a card for each remaining player from a pile of cards with symbols displayed thereon from the second symbol group, and allowing a player concerned at least to retain his bet, provided that the symbol on the card which has been turned over corresponds to the symbol from the second symbol group in the image before him.

10. Method according to claim 9, in which the player who compared with the other player positions has the highest symbol from the first symbol group in the image before him is paid out double.

11. Method according to claim 9, in which in several rounds of the game a jackpot is built up by special jackpot bets of players, which jackpot is paid out only to those players who have placed a bet in the jackpot during a certain round of the game and also meet a certain limiting condition with the image before them.

12. Method according to claim 9, in which an additional game is played with the players who compared with the other player positions do not have the highest or lowest symbol from the first symbol group in the image before them.

13. Method according to claim 9, in which an additional pay-out is made to players with a certain combination of symbols and/or images.

* * * * *